US005237898A

United States Patent [19]

Kubisiak

[11] Patent Number: 5,237,898

[45] Date of Patent: Aug. 24, 1993

[54] AUTOTAPER

[75] Inventor: Gregg F. Kubisiak, Whitehall, Wis.

[73] Assignee: Check Technology Corporation, St. Paul, Minn.

[21] Appl. No.: 979,210

[22] Filed: Nov. 20, 1992

[51] Int. Cl.[5] ..... B26D 5/20

[52] U.S. Cl. ..... 83/227; 83/241; 83/339; 83/349; 83/368; 83/436; 83/560; 83/649; 83/734; 83/922

[58] Field of Search ..... 83/222, 225, 227, 229, 83/241, 339, 349, 368, 436, 559, 560, 597, 649, 674, 700, 922, 934, 734; 156/216, 360, 353, 479; 412/6, 8, 16, 36, 37

[56] References Cited

U.S. PATENT DOCUMENTS

| | | | |
|---|---|---|---|
| 3,695,133 | 10/1972 | Finke | 83/222 X |
| 4,046,039 | 9/1977 | Griesbach | 83/560 X |
| 4,656,903 | 4/1987 | Peyre | 83/611 X |
| 4,901,611 | 2/1990 | Bentley | 83/368 X |
| 4,986,155 | 1/1991 | Hays, Jr. | 83/222 |

*Primary Examiner*—Eugenia Jones

*Attorney, Agent, or Firm*—Merchant, Gould, Smith, Edell, Welter & Schmidt

[57] ABSTRACT

An autotaper for use in dispensing, cutting and locating tape. The autotaper is comprised of a base having a sliding mount attached to the base and disposed at an angle to the direction in which the tape is dispensed and a device for translating and positioning the sliding mount to a predetermined location on the base; and a feedhead attached to the sliding mount, having a rotatable shaft, a first feed roller mounted to the shaft in a manner that causes the first feed roller to rotate with the shaft when the shaft is rotated in a first direction and not to rotate with the shaft when the shaft is rotated in a second direction, a second feed roller rotatably attached to the feedhead that is in frictional contact with the first feed roller such that the second feed roller rotates in conjunction with the first feed roller, a device for cutting the tape, a linkage assembly attached to the shaft such that the linkage assembly rotates with the shaft when the shaft is rotated in a second direction to activate the cutting device and not to rotate or activate the cutting device when the shaft is rotated in a first direction, and a device for rotating the shaft for a predetermined amount in either the first or second directions.

18 Claims, 6 Drawing Sheets

AUTOTAPER

FIELD OF INVENTION

The present invention relates to an apparatus for dispensing, cutting and locating continuous flexible articles and more particularly to an automated apparatus for dispensing, cutting and locating tape.

BACKGROUND OF INVENTION

Automatic taping devices are typically used as part of larger machines that are used to bind booklets such as personal checks. These machines will typically cut a stack of papers that will become the booklet to the proper size, staple the papers together on one end and translate the booklets to a position in front of the taping device. The taping device then dispenses and cuts a predetermined amount of tape, locating a portion of the tape on the top of the booklet. The machine then binds the tape to the top of the booklet, and wraps and binds the tape onto the side and bottom of the booklet.

These taping devices must be capable of performing the several functions. First, the taping devices in these machines must be capable of dispensing and cutting the proper amount of tape for booklets having various thicknesses. Second, the taping devices must be capable of locating the tape on the booklet so that an equal amount of tape is positioned on both the top and the bottom of the booklet.

Current taping devices, as shown in FIGS. 1-3, perform these functions by using a complex configuration that includes a cam driven, tape feed roller 50, best shown in FIG. 2, and a cutter assembly driven by a separate electric motor 51, best shown in FIG. 3. Therefore, two separate motors are used to drive the tape feed assembly and the cutter assembly. The amount of tape dispensed and the position of the taping device relative to the booklet are adjusted by manual controls 52.

The positioning of the taping device relative to the booklets and the amount of tape dispensed are critical to achieving a bound booklet that has an equal amount of tape positioned on both the top and the bottom of the booklet. The amount of tape to be dispensed and the positioning of the autotaper device relative to the booklet to achieve this result also vary with different book thicknesses. Therefore, the controls 52 must be readjusted for each different book thickness. In addition, some slippage may occur during the operation of the current taping devices. Therefore, the controls may also need to be adjusted during repeated operation of the device for booklets having a uniform thickness.

SUMMARY OF INVENTION

The present invention improves on the current taping devices by utilizing a configuration that eliminates the need for two separate motors to drive the tape feed and cutting assemblies. The present invention is also configured to automatically adjust and reliably maintain the position of the device relative to the booklet so that an equal amount of tape is located on the top and bottom of a booklet of any thickness.

The present invention is for an automatic apparatus for dispensing, cutting and locating tape. The invention is comprised of a base and a feedhead. The feedhead is attached to a sliding mount located on the base that translates at an angle relative to the direction in which the tape is dispensed. The sliding mount is also attached to a device for translating the sliding mount to a predetermined location on the base. The feedhead is comprised of a rotatable shaft, a first feed roller, a second feed roller, a cutting assembly and a linkage assembly attached to the shaft and cutting assembly. The first feed roller is mounted to the shaft in a manner such that the first feed roller will rotate with the shaft when the shaft is rotated in a first direction, but will not rotate with the shaft when the shaft is rotated in a second direction. The linkage assembly is attached to the shaft in a similar manner, except that the linkage assembly will rotate with the shaft when the shaft is rotated in the second direction to operate the cutter assembly, but will not rotate with the shaft when the shaft is rotated in the first direction. The second feed roller is in frictional contact with the first feed roller so that the second feed roller rotates in conjunction with the first feed roller to dispense the tape. The invention also contains a device for rotating the shaft a predetermined amount in the first and second directions.

Therefore, the present invention utilizes a single device for operating both the feed assembly and the cutting assembly. When the device rotates the shaft in the first direction, the feed roller assembly is operated and tape is dispensed. When the shaft is rotated in the second direction, the tape dispensing assembly is not operated and the linkage assembly is operated to drive the cutting assembly.

In one embodiment, the feedhead would be mounted on the base at a 45° angle. The mounting of a feedhead on the base at a 45° degree angle to the direction in which the tape is dispensed insures that an equal amount of tape will be dispensed on both the top and the bottom of the booklet. To achieve this result, the device would be configured to dispense a reference amount of tape that would be equal to the amount of tape that was desired to be placed on the top and bottom of a booklet of zero thickness. The feedhead would be positioned at a distance of one-half of the reference amount of tape from the booklet at a vertical position equal to the top of a booklet with a zero thickness. This position would be the reference position for the feedhead.

When the thickness of the book is determined, the amount of tape dispensed would be equal to the reference amount of tape plus the book thickness. The sliding mount would also be moved to a new vertical position that was equal to the reference point plus the thickness of the booklet. Because the feedhead is mounted at a 45° angle to the direction in which the tape is dispensed, the sliding mount would also be moved away from the booklet by an amount equal to the thickness of the booklet. Therefore, when the required amount of tape was dispensed (reference amount of tape plus thickness of book), one-half of the reference amount of tape would again be placed on the top of the booklet and the other half of the reference amount of tape would be placed on the bottom of the booklet.

In another embodiment, the present invention is combined with a sensor and controller. The sensor would be mounted to the larger machine and would sense the thickness of the booklet prior to the booklet reaching its position in front of the autotaper. The sensor would then send a signal to the controller which would activate the device for translating the sliding mount to the proper location. The controller would also operate the motor for rotating the shaft in the first direction to dispense the proper amount of tape and to rotate the shaft in the second direction to cut the tape after the proper amount had been dispensed.

The present invention is further explained hereinafter with more particularity in reference to the preferred embodiment as shown in the following drawings.

DETAILED DESCRIPTION OF THE PREFERRED EMBODIMENT

The preferred embodiment of the present invention will be described as used for dispensing pressure or heat sensitive tape for binding personal checks or other paper booklets. This application requires a device that can dispense, cut and locate a predetermined amount of pressure sensitive tape on a stack of papers to form a bound booklet of papers having an equal amount of tape on the top and bottom of the booklet. However, those skilled in the art would recognize that the present invention could be used to dispense, locate and cut any continuous article, such as paper, wire, plastic films or other than flexible materials.

Figure 1:
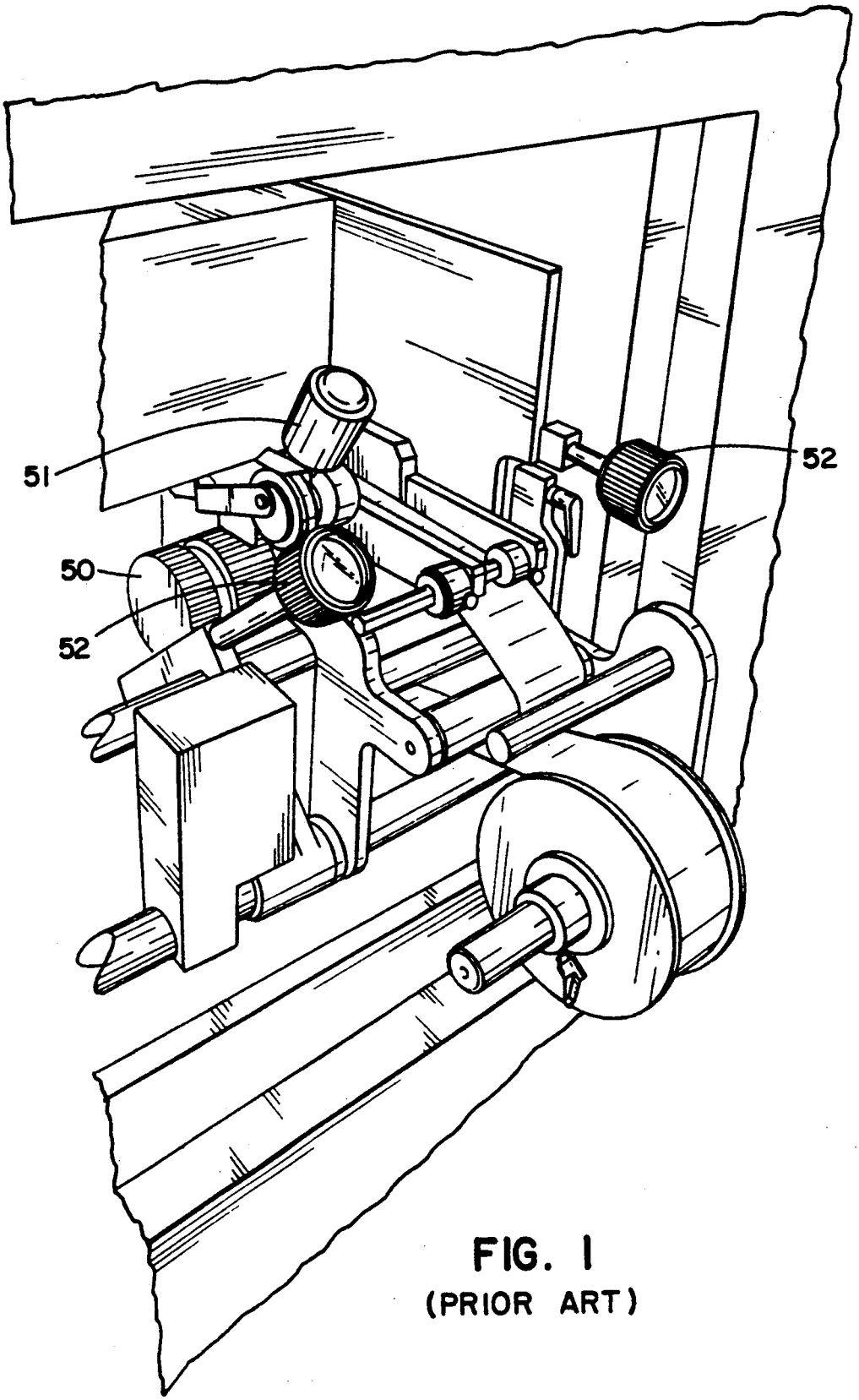
FIG. 1 (PRIOR ART)
FIG. 1 is a perspective view of a prior art version of a taping device with portions broken away.
Figure 3:
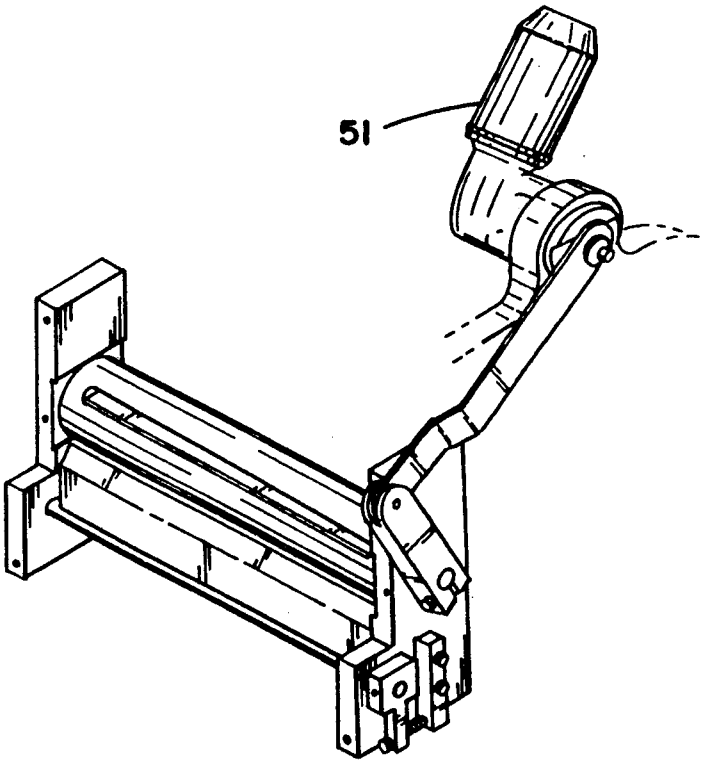
FIG. 3 (PRIOR ART)
FIG. 3 is a perspective view of a cutter assembly used in the device in FIG. 1 with portions broken away.
Figure 2:
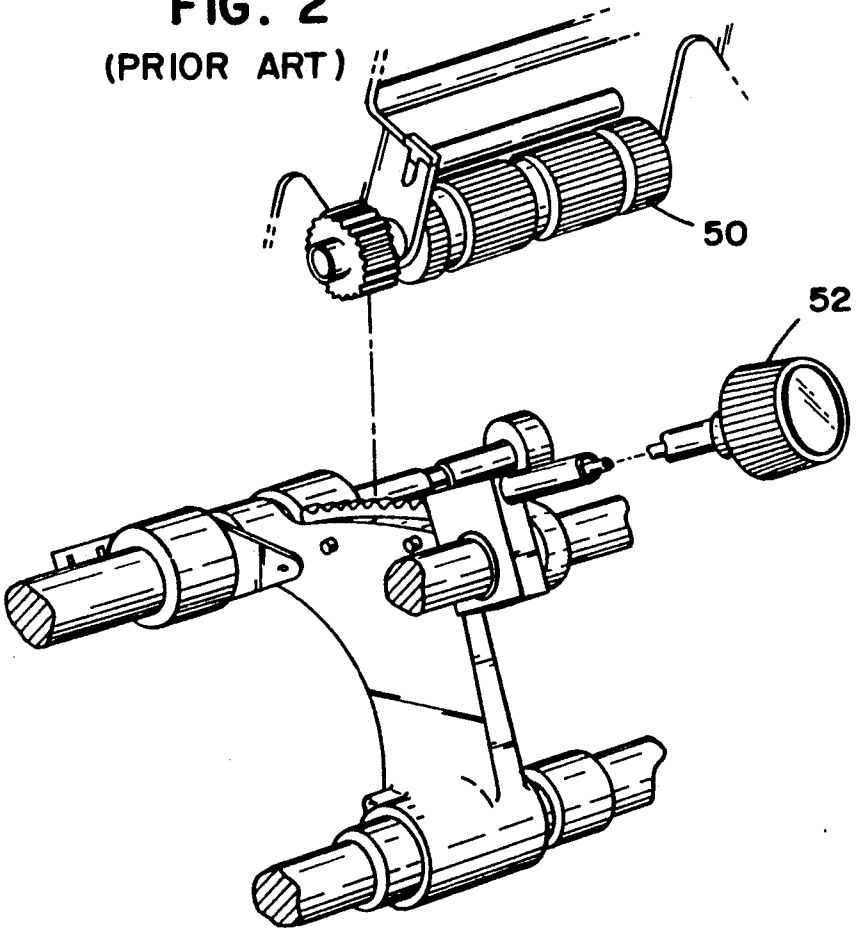
FIG. 2 (PRIOR ART)
FIG. 2 is a perspective view of the tape feed assembly used in the device in FIG. 1 with portions broken away.
Figure 4:
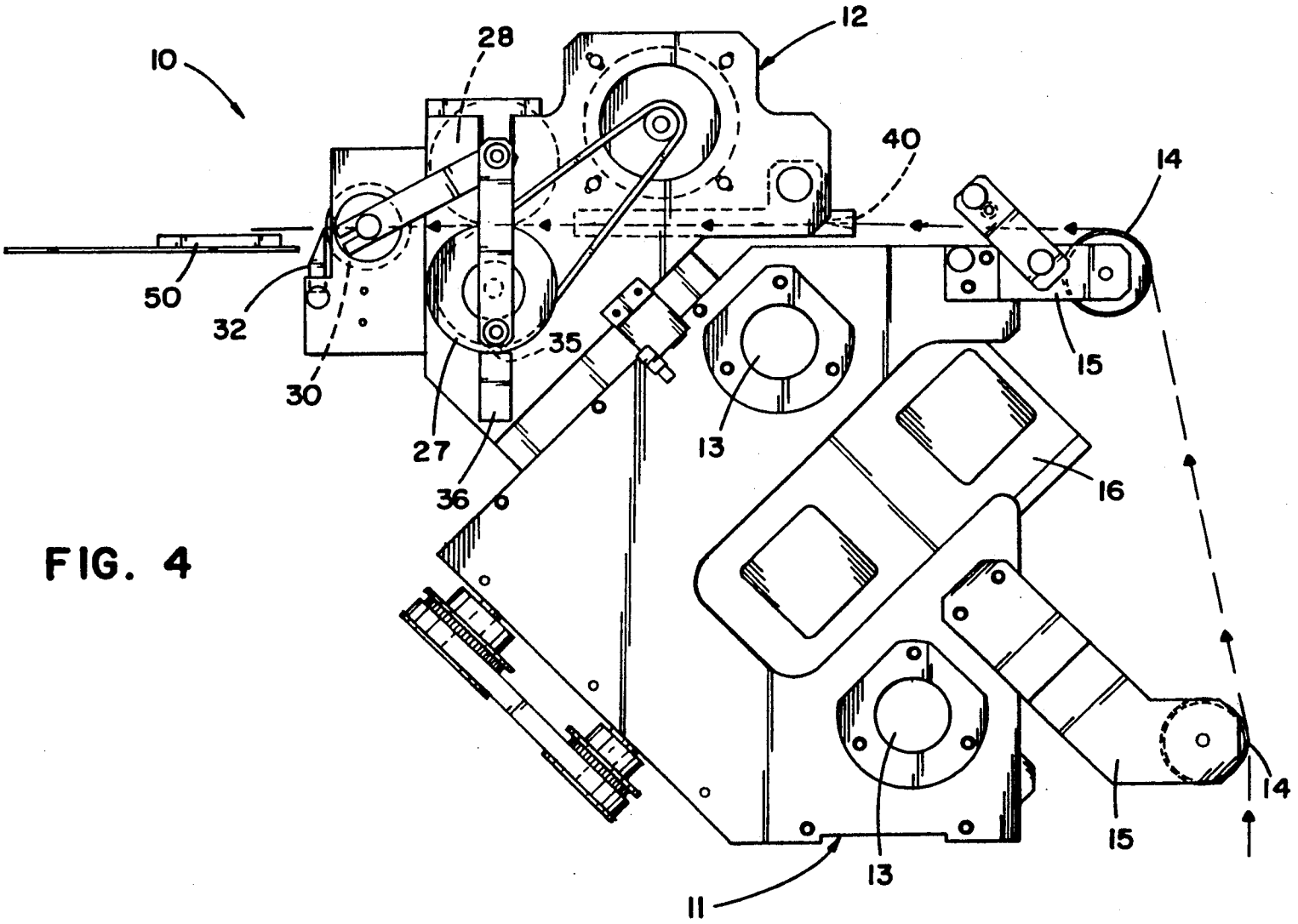
FIG. 4 is a side plan view of the preferred embodiment of the invention.

Referring to the drawings wherein like numerals designate like parts, the preferred embodiment of the invention is an autotaping apparatus, generally designated as 10, comprised of a base 11 and a feedhead 12. As shown in FIG. 4, the autotaper 10 dispenses, locates and cuts a predetermined amount of tape onto the top of a booklet 50 that is positioned in front of the autotaper 10. When in use, tape is positioned over guide rollers 14 that are attached to the base 11 by guide brackets 15. The tape is then fed through a tape guide 40 located in the feedhead 12 and between lower and upper feed rollers 27, 28. As the feed rollers 27, 28 rotate, the tape is fed through a cutter barrel 30 and onto the top of a booklet 50 as shown. The portion of the tape extending over the booklet 50 is pressed onto the booklet 50 and the tape is cut by knife blade 32. The tape is then wrapped around the side of the booklet 50 and onto the bottom of the booklet 50.

The autotaper 10 would generally be a portion of a larger machine that cuts a stack of papers to the correct size, transfers them to the location in front of the autotaper 10 which dispenses, cuts and locates the proper amount of tape on the papers, and then secures the tape to the papers. In the preferred embodiment, the base 11 is rigidly mounted to the larger machine. Two mount apertures 13 located in the base 11 are arranged and configured to enable the base 11 to be slid onto mounting rods (not shown) on the larger machine. The base can then be secured to the mounting rods.

Figure 5:
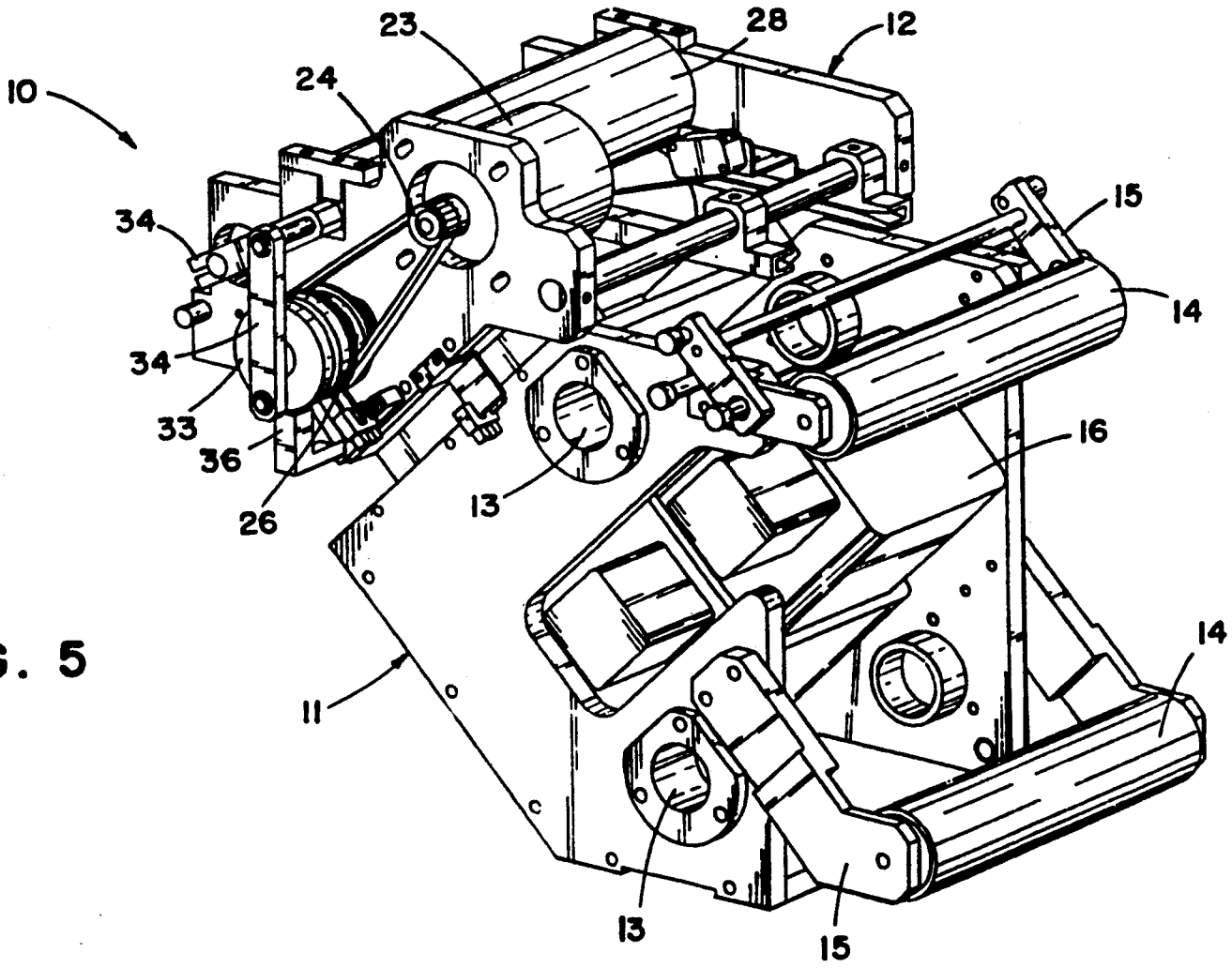
FIG. 5 is a perspective view of the preferred embodiment of the invention.
Figure 6:
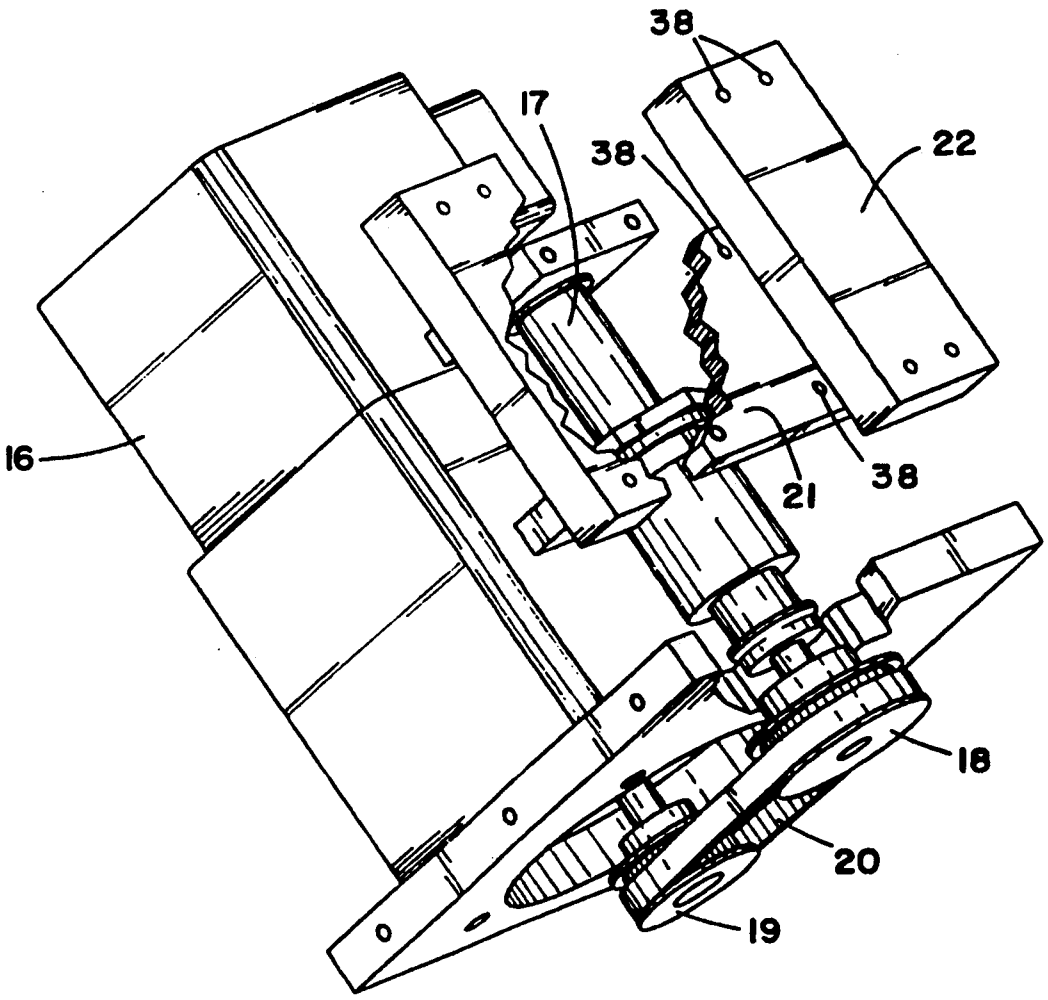
FIG. 6 is a perspective view of the preferred embodiment of the base and sliding mount assembly for use with the invention with portions broken away.

As shown in FIGS. 4 and 5, the feedhead 12 is slidably mounted on the base 11 at a 45° angle relative to the booklet 50. As shown in FIG. 6, the preferred embodiment uses a servo motor 16, ball screw 17 and sliding mount 21 combination located within the base 11 to slidably mount the feedhead 12 relative to the base 11. The ball screw 17 is attached to the sliding mount 21 and a first pulley 18. The servo motor 16 is attached to a second pulley 19. The first pulley 18 is operatively connected to the second pulley 19 by a belt 20. When the thickness of the booklet 50 is determined, a signal is sent to the servo motor 16 which then rotates the second pulley 19. The rotation of the second pulley 19 rotates the first pulley 18 which rotates the ball screw 17, thereby adjusting the location of the sliding mount 21.

A servo motor 16 with an 8000 pulse/rev encoder is used in the preferred embodiment because of its fast response time, however, any electric motor which can be rotated in both a counterclockwise and clockwise direction for a predetermined amount could be used. The preferred embodiment would also use a zero backlash, high precision ball screw 17. This type of ball screw 17 is preferred because it is designed to prevent slippage, therefore, insuring the accurate placement of the feedhead 12 in relation to the booklet 50. The feed head 12 is then attached to the sliding mount 21 by inserting threaded fasteners into fastening apertures 38 located in the sliding mount 21 or any other suitable fastening means.

In the preferred embodiment, sliding guides 22 would also be attached to the base 11 and located adjacent to the sliding mount 21. The sliding guides 22 are arranged and configured to translate freely in the same direction as the sliding mount 21. The sliding guides 22 would also have fastening apertures 38 for mounting the feedhead 12. These sliding guides 22 are used because they add more support to feedhead mounting system.

Figure 7:
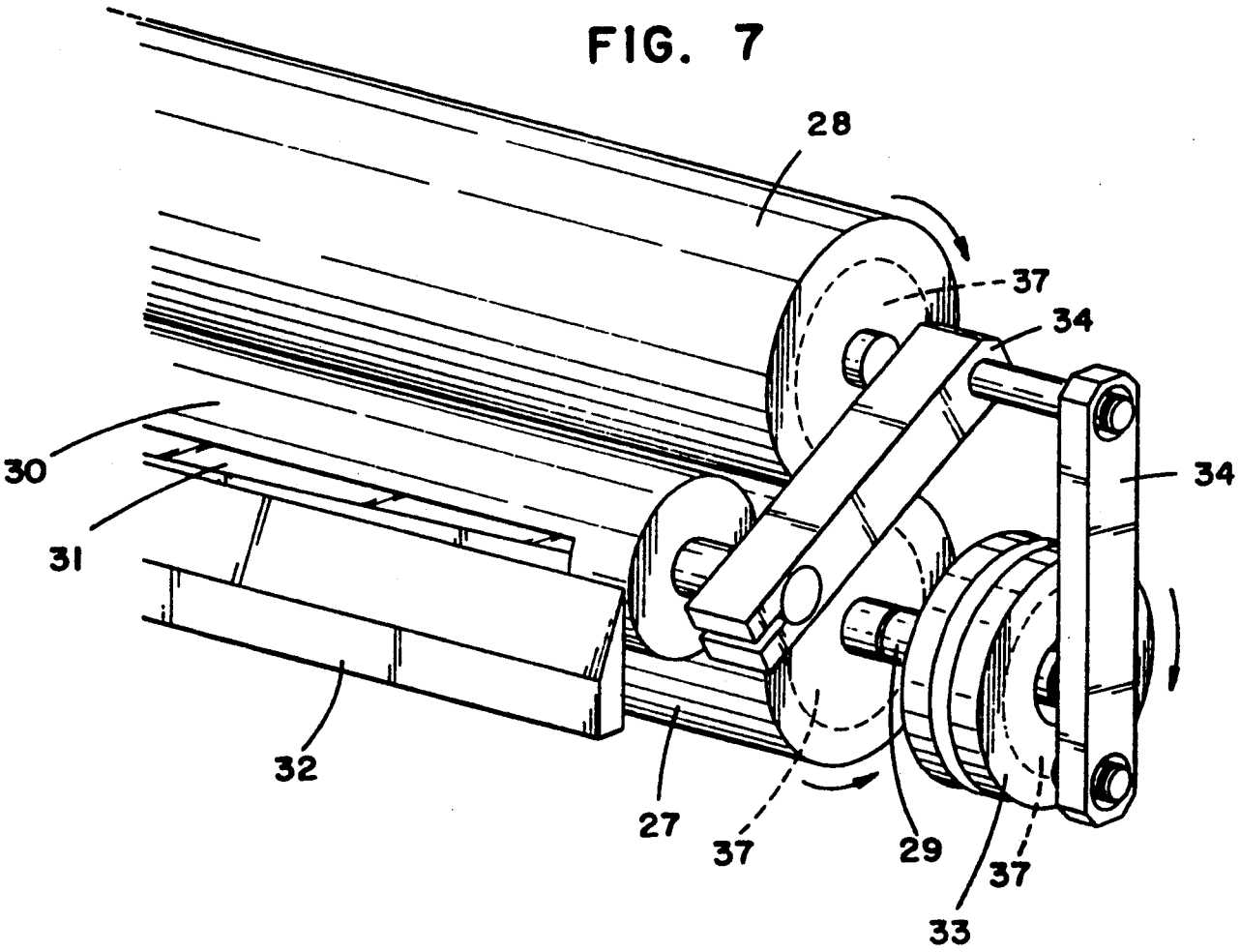
FIG. 7 is a perspective view of the preferred embodiment of the feed assembly and cutting assembly for use with the invention with portions broken away.

Now referring to FIGS. 4, 5 and 7, the feedhead 12 would contain a stepper motor 23, a lower feed roller 27, an upper feed roller 28, a cutter barrel 30 and a knife blade 32. The stepper motor 23 is used to drive both the means for dispensing the tape and the means for cutting the tape. A stepper motor 23 is preferred because it is capable of being rotated either a clockwise or a counterclockwise direction through a specified number of steps per revolution. Those skilled in the art would recognize that other types of motors could be used with the present invention. In the preferred embodiment, the stepper motor 23 drives the lower feed roller 27 and cutter barrel 30 by means of a second belt 25 which connects the stepper motor shaft 24 and a third pulley 26 mounted on the lower feed roller shaft 29. The third pulley 26 is securely fastened to the stepper motor shaft 24 so that rotation of the third pulley 26 causes a corresponding rotation of the lower feed roller shaft 29.

Now referring to FIG. 7, the lower feed roller 27 is attached to the lower feed roller shaft 29 by two one-way roller clutch bearings 37, one located at each end of the lower feed roller 27. When the lower feed roller shaft 29 is rotated in the counterclockwise direction, the one-way roller clutch bearings 37 lock up and drive the lower feed roller 27 in a counterclockwise direction. When the lower feed roller shaft 29 is rotated in the clockwise direction, the roller clutch bearings 37 do not lock up and the lower feed roller 27 does not rotate.

The lower feed roller 27 is preferably made from a light weight material having a hard surface. A light weight material is preferred to reduce the mass of the lower feed roller 27. If the mass of the lower feed roller 27 were too high, the momentum of the lower feed roller 27 during rotation by the stepper motor 23 could cause the lower feed roller 27 to continue to rotate after the stepper motor 23 stops, thereby dispensing too much tape.

The stepper motor 23 chosen for the preferred embodiment is a Super Electric MO62-CE09 TM, which has 200 steps per revolution. The stepper motor 23 is driven in half step mode (400 step/rev) and the ratio of the diameter of the third pulley 26 to the diameter of the stepper motor shaft 24 is 3:1. In addition, the lower feed roller 27 in this application would preferably have a circumference of 6.0 inches. This particular arrangement results in 0.005 inches of tape to be fed per step, approximately the thickness of one check in a booklet 50. This arrangement also results in a device that can run up to 2000 booklets per hour.

The upper feed roller 28 is rotatably attached to the feedhead 12 and is in frictional contact with the lower feed roller 27. This frictional contact causes the upper feed roller 28 to rotate in a clockwise direction when the lower feed roller 27 rotates. The upper feed roller 28 is preferably coated with rubber or a similar material to enable the upper feed roller 28 to better grip the tape as the tape is dispensed between the upper and lower feed rollers 27, 28. The upper feed roller 28 is also preferably mounted on one way clutch bearings 37 which lock-up in the counterclockwise direction to help prevent slippage and backward feeding of the tape.

A hub 33 is also attached to the lower feed roller shaft 29 and has one-way clutch bearings 37 that are arranged to lock-up in the opposite direction as the one-way clutch bearings 37 on the lower feed roller 27, a clockwise direction. Therefore, when the lower feed roller 27 is engaged, the hub 33 does not rotate and when the hub 33 is engaged, the lower feed roller 27 does not rotate.

As shown in FIG. 7, the hub 33 is attached to the cutter barrel 30 by means of linkage arms 34. As the hub 33 is rotated, linkage arms 34 act to rotate the cutter barrel 30. The cutter barrel 30 also has a slot 31 therethrough which is arranged and configured to align with the frictional contact area between the upper and lower feed rollers 27, 28 to enable the tape to pass through the slot. A spring loaded knife blade 32 is also attached to the feedhead 12 and is positioned to be tangential to the cutting barrel 30. Therefore, when the cutter barrel 30 is rotated, the tape is pinched between the cutter barrel 30 and the knife blade 32 creating a shearing action to cut the tape. Those skilled in the art would recognize that other cutter assemblies could be used with the present invention, including assemblies where the knife blade 32 translates, assemblies where a cutter barrel type devise translates instead of rotating, or other well known cutting assemblies known in the art.

Now referring to FIGS. 4 and 5, the preferred embodiment would also include a detent 35 drilled into the hub 33 and a spring loaded ball plunger 36 mounted to the feedhead 12 and aligned with the detent 35 when the slot 31 in the cutter barrel 30 is in a non-cutting position. The spring force of the spring loaded ball plunger 36 would be greater than the friction in the one-way clutch bearings 37 when the hub 33 is rotated in a counterclockwise direction, but would be far less than the force exerted on the hub 33 when the stepper motor 23 rotates the hub 33 in a clockwise direction. This arrangement eliminates the possibility of slippage in the cutting assembly.

The preferred embodiment of the invention would also be preset to dispense three-quarters of an inch of tape at a book thickness of zero inches. The feedhead 12 would also be positioned at a reference point which would result in the dispensing of three-eighths of an inch of tape on top of a booklet 50 with a thickness of zero inches and three-eights of an inch of tape extending from the end of the booklet 50. The autotaper 10 would also preferably be combined with a sensor that would determine the thickness of a booklet 50 before the booklet 50 reached a position in front of the autotaper 10. The sensor would then transfer the thickness information to a controller for use with the autotaper 10. Those skilled in the art would recognize that any well known sensor and controller could be used with the invention. The servo motor 16 would receive a signal from the controller and would rotate a corresponding amount to operate the ball screw 17 so that the sliding mount 21 moved the feedhead 12 to a vertical position above the reference point that was equal to the thickness of the book. Because the feedhead 12 is mounted to the base 11 on a 45° angle relative to the booklet 50, the feedhead would also be moved away from the booklet 50 by an amount equal to the thickness of the booklet.

The stepper motor 23 would also receive a signal from the controller and would rotate in a counterclockwise direction for the number of steps corresponding to the dispensing of three-quarters of an inch plus the thickness of the booklet 50 of tape. As described earlier, the rotation of the stepper motor in a counterclockwise direction operates the lower feed roller 27, which in turn dispenses the required amount of tape. The stepper motor 23 would then receive a signal to rotate in the clockwise direction to cut the tape.

Because the feedhead 12 has been moved an equal distance in both vertical and horizontal directions from the reference point, the dispensing of an amount of tape equal to three-quarters of an inch plus the thickness of the booklet 50 results in three-eighths of an inch of tape being positioned on the top and the bottom of the booklet 50 regardless of the thickness of the booklet 50. Therefore, the present invention will automatically and consistently place an equal amount of tape on the top and the bottom of any size booklet 50.

Although characteristics and advantages, together with details for structure, materials, function and process steps, have been described in reference to a preferred embodiment herein, it is understood that the disclosure is illustrative. To that degree, various changes made especially to matters of shape, size and arrangement, to the full extent extended by the general meaning of the terms in which the appended claims are expressed, are within the principles of the present invention.

What is claimed is:

1. An apparatus for dispensing and cutting tape comprising:

a. a base;

b. a sliding mount attached to the base and disposed at an acute angle to the direction in which the tape is dispensed;

c. a feedhead attached to the sliding mount;

d. means for translating the sliding mount to a predetermined location on the base;

e. a shaft rotatably attached to the feedhead;

f. a first feed roller mounted to the shaft that is arranged and configured to rotate with the shaft when the shaft is rotated in a first direction and not to rotate with the shaft when the shaft is rotated in a second direction;

g. a second feed roller rotatably attached to the feedhead that is in frictional contact with the first feed roller so that the second feed roller rotates in the second direction and in conjunction with the first feed roller to dispense tape;

h. cutting means for cutting the tape;

i. linkage means attached to the shaft that is arranged and configured to activate the cutting means when the shaft is rotated in the second direction and not to activate the cutting means when the shaft is rotated in the first direction; and j. means for rotating the shaft for a predetermined amount in either the first or second directions.

2. An apparatus for dispensing and cutting tape according to claim 1, wherein the apparatus further comprises sensing means for determining the amount of tape to be dispensed.

3. An apparatus for dispensing and cutting tape according to claim 1, wherein the means for translating and positioning the sliding mount is a ball screw that is attached to the sliding mount and that is operatively connected to a servo motor which rotates the ball screw.

4. An apparatus for dispensing and cutting tape according to claim 1, wherein the first feed roller is mounted to the shaft by one-way clutch bearings which lock onto the shaft when the shaft is rotated in a first direction to rotate the first feed roller, but which do not lock onto the shaft when the shaft is rotated in a second direction.

5. An apparatus for dispensing and cutting tape according to claim 1, wherein the linkage means comprises a hub attached to the shaft by one-way clutch bearings such that the hub is rotated when the shaft is rotated in the second direction, but is not rotated when the shaft is rotated in the first direction and linkage arms that are connected between the hub and the cutting means such that the cutting means are activated when the hub rotates.

6. An apparatus for dispensing and cutting tape according to claim 5, wherein the cutting means is a rotatable cutting barrel with a slot therethrough that is adjacent to a knife blade.

7. An apparatus for dispensing and cutting tape according to claim 1, wherein the second feed roller further comprises one-way clutch bearings to prevent the second feed roller from rotating in the first direction.

8. An apparatus for dispensing and cutting tape according to claim 1, wherein the means for rotating the shaft in the first and second directions is a stepper motor.

9. An apparatus for dispensing and cutting tape according to claim 1, wherein the apparatus further comprises sensing means for determining the amount of tape to be dispensed and for determining the predetermined location for the sliding mount.

10. An apparatus for dispensing and cutting tape according to claim 1, wherein the sliding mount is disposed at a 45° angle to the direction in which the tape is dispensed.

11. An apparatus for dispensing and cutting tape comprising:

a. a base;

b. a sliding mount disposed at a 45° angle to the direction at which the tape is dispensed;

c. a feedhead attached to the sliding mount;

d. a ball screw attached to the sliding mount for positioning the sliding mount at a predetermined location;

e. means for rotating the ball screw;

f. a shaft rotatably attached to the feedhead;

g. a first feed roller mounted on the shaft by one-way clutch bearings that are arranged and configured to engage the shaft and rotate the first feed roller when the shaft is rotated in a first direction and to not engage the shaft when the shaft is rotated in a second direction;

h. a second feed roller rotatably attached to the feedhead that is in frictional contact with the first feed roller such that the second feed roller rotates in the second direction when the first feed roller rotates in the first direction;

i. a hub attached to the shaft by one-way clutch bearings that are arranged and configured to engage the shaft and rotate the hub when the shaft is rotated in the second direction and to not engage the shaft or rotate the hub when the shaft is rotated in the first direction;

j. a cutting barrel and knife blade assembly for cutting the tape;

k. linkage arms attached to the hub and cutting barrel that are arranged and configured so that the cutting barrel is rotated to cut the tape when the hub is rotated in the second direction; and l. means for rotating the shaft a predetermined amount in the first and second directions.

12. An apparatus for dispensing and cutting tape according to claim 11, wherein the means for rotating the shaft in the first and second directions is a stepper motor.

13. An apparatus for dispensing and cutting tape according to claim 11, wherein the means for rotating the ball screw is a servo motor that is connected to the ball screw by a pulley and belt system.

14. An apparatus for dispensing and cutting tape according to claim 11, wherein the first feed roller is made of aluminum.

15. An apparatus for dispensing and cutting tape according to claim 11, wherein the second feed roller is mounted to the feedhead with one-way clutch bearings to prevent the second feed roller from rotating in the first direction.

16. An apparatus for dispensing and cutting tape according to claim 11, wherein the second feed roller is covered with a rubber material.

17. An apparatus for dispensing and cutting tape according to claim 11, wherein the apparatus further comprises sensing means for determining the amount of tape to be dispensed and the predetermined location of the sliding mount.

18. An apparatus for dispensing and cutting tape according to claim 11, wherein the apparatus further comprises a spring loaded plunger that is attached to the feed head and aligned with a detent located in the hub.

* * * * *

UNITED STATES PATENT AND TRADEMARK OFFICE

CERTIFICATE OF CORRECTION

PATENT NO. : 5,237,898

DATED : 8/24/93

INVENTOR(S) : Gregg F. Kubisiak

It is certified that error appears in the above-identified patent and that said Letters Patent is hereby corrected as shown below:

Column 8, line 5, delete "at" insert thereto --in--

Column 8, line 31, insert thereto --the-- after "and"

Signed and Sealed this

Fifth Day of April, 1994

*Attest:*

*Attesting Officer*

Bruce Lehman

BRUCE LEHMAN

*Commissioner of Patents and Trademarks*